United States Patent [19]

Farnam

[11] 4,056,707

[45] * Nov. 1, 1977

[54] ELECTRICAL HEATING DEVICE FOR USE WITH AEROSOL CONTAINERS

[76] Inventor: Franklin C. Farnam, 19 Glenview Road, Asheville, N.C. 28804

[ * ] Notice: The portion of the term of this patent subsequent to Aug. 31, 1990, has been disclaimed.

[21] Appl. No.: 619,599

[22] Filed: Oct. 6, 1975

[51] Int. Cl.[2] ..... H05B 1/02; B67D 5/62; F24H 1/12

[52] U.S. Cl. ..... 219/302; 219/214; 219/305; 219/308; 219/328; 222/146 HA; 239/133; 239/135

[58] Field of Search ..... 219/296–309, 219/214, 328; 222/146 R, 146 HA, 146 HE; 239/133, 135; D6/95; D9/258

[56] References Cited

U.S. PATENT DOCUMENTS

| | | | |
|---|---|---|---|
| 3,338,476 | 8/1967 | Marcoux | 219/214 X |
| 3,588,469 | 6/1971 | Dillarstone | 219/301 X |
| 3,644,707 | 9/1970 | Costello | 219/214 X |
| 3,710,985 | 1/1973 | Baum | 219/302 X |
| 3,846,614 | 11/1974 | Doyle et al. | 219/302 |
| 3,891,827 | 6/1975 | Wyse | 219/302 |
| D. 241,202 | 8/1976 | Farnam | D6/95 |
| D. 241,203 | 8/1976 | Farnam | D6/95 |

FOREIGN PATENT DOCUMENTS

| | | | |
|---|---|---|---|
| 1,060,802 | 7/1959 | Germany | 239/133 |

*Primary Examiner*—A. Bartis

*Attorney, Agent, or Firm*—Bell, Seltzer, Park & Gibson

[57] ABSTRACT

A device for heating lather dispensed from an aerosol can comprises a housing enclosing a heat sink having lather directing channels establishing fluid flow communication between an entrance orifice adapted to receive the outlet nozzle of the can and an exit orifice for delivering heated lather. The heat sink is heated by a thermostatically controlled electric heating element and a male connector on the housing closely adjacent the inlet orifice allows the device to be plugged into an electrical receptacle for heating the heat sink to a predetermined temperature prior to use. The heat sink has a thermal capacity to heat at least three grams of lather foam to a temperature of about 120°–140° F. after being plugged in for approximately one minute. As a safety feature, the heating device must be disconnected from the receptacle prior to attachment to the aerosol can, since the entrance orifice is physically located on the same exterior housing surface as the male connector and in such proximate position relative thereto as to prohibit simultaneous connection of the male plug to an electrical receptacle and the nozzle of the can to the entrance orifice.

6 Claims, 6 Drawing Figures

ELECTRICAL HEATING DEVICE FOR USE WITH AEROSOL CONTAINERS

BRIEF DESCRIPTION OF THE PRIOR ART

In recent years aerosol foam lathers have become popular for supplying shaving lubricants for man's seemingly never ceasing war with whiskers. For those who prefer a hot shaving lather, a major difficulty has been in obtaining sufficient heat for their lather, since mixing the aerosol lather with hot water sufficient to heat the lather often dilutes it beyond use.

A number of means of heating lather have been used, including chemical heating means added to the lather, heating elements within the aerosol lather can, and hot water reservoirs having heat transfer coils therein through which the aerosol foam from the can passes.

U.S. Letters Pat. No. 2,873,351 describes a device attachable to an outlet of an aerosol foam lather can to heat lather from the can, one embodiment having an electrical resistance coil around a lather channel in the device. An electrical outlet plug and length of electrical wiring is connected through switch means to the resistance coil, through which electrical energy is converted to heat the lather channel while in use.

U.S. Letters Pat. No. 3,644,707 is directed to a lather heating device in which heat energy is transmitted to a heat storage medium through a resistance coil attachable to an electrical outlet plug through a short length of electrical wire and male plug; or, in one embodiment, male plug prongs built directly into the device housing. The device uses no switches, fuses, or thermostatic controls to regulate temperature of the heat storage medium. A difficulty with the aforesaid device, however, is the difficulty in determining the temperature of the device; further, it is possible to leave the heating device plugged in while attempting to obtain lather which may subject the user to possible shock and electrical burns.

BRIEF DESCRIPTION OF THE PRESENT INVENTION

The present invention is directed to an improvement in lather heating devices attachable to aerosol containers and the like and comprises a truly portable housing having male electrical prongs built in thereto, the housing design being directed to minimizing overhang of the lather heating device while plugged into an electrical receptacle. The male prongs are connected to a heating coil through a thermostatically operated switch; the coil, when energized, transmitting heat energy proportionately through suitable heat transfer media to the switch and a heat sink having appropriately designed lather directing channels. When the desired heat temperature is reached, the thermostatic switch is opened from the heating coil and closed to a lamp to indicate readiness of the device for use.

The heating device must then be removed from the electrical receptacle before attachment to an aerosol container valve since the device adapter for the aerosol can is physically located on the same exterior surface as the male electrical prongs, and in a proximate position to prohibit simultaneous use of either an electrical wall outlet or extension cord and an aerosol can.

Figure 1:
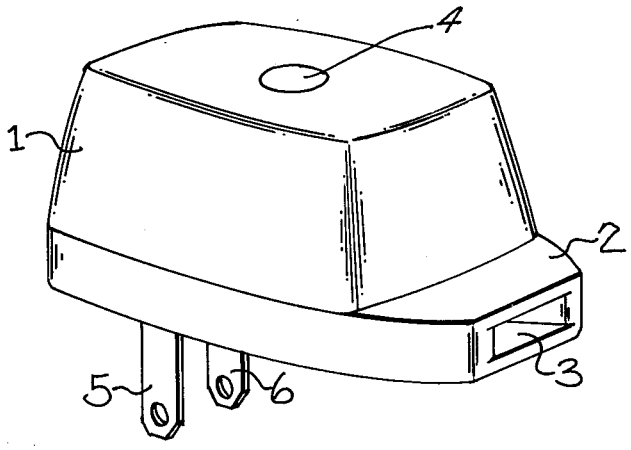
FIGS. 1 and 2 are perspective and side views of one embodiment of the lather heating device herein.
Figure 2:
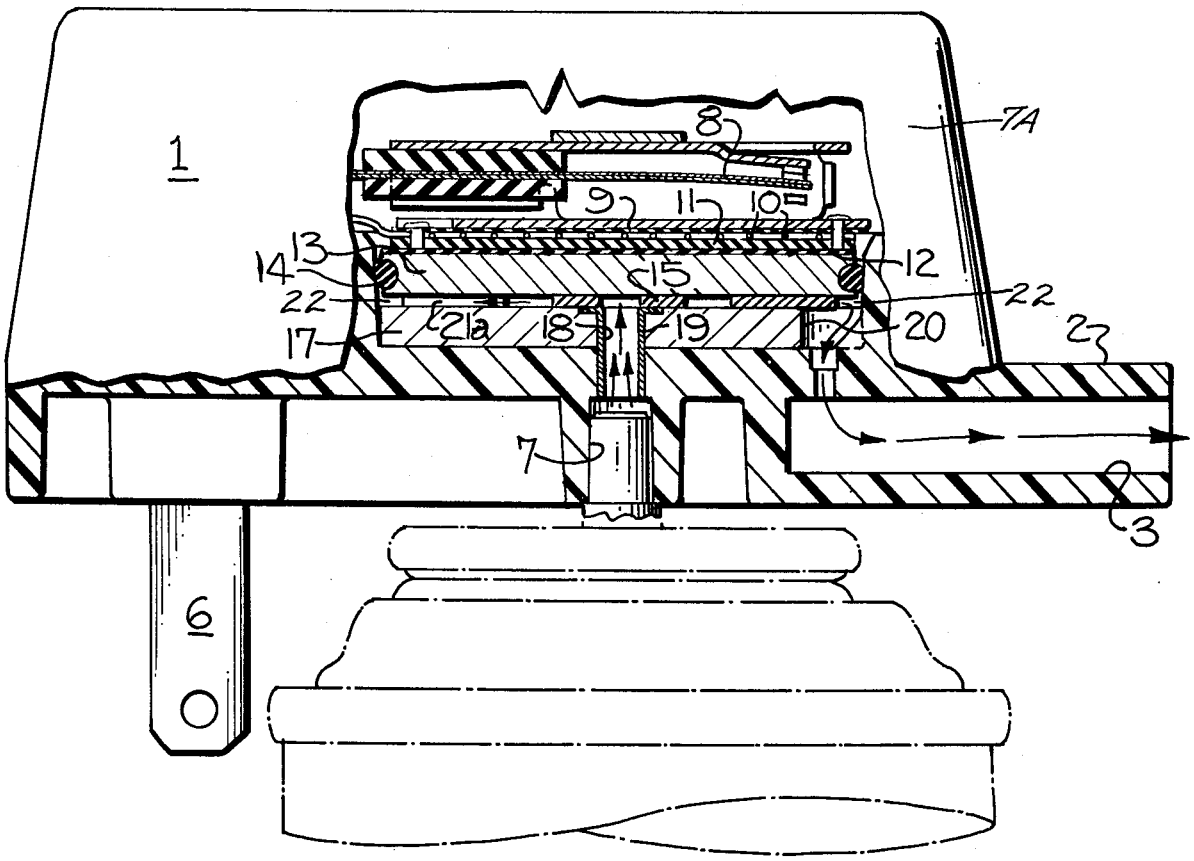
Figure 3:
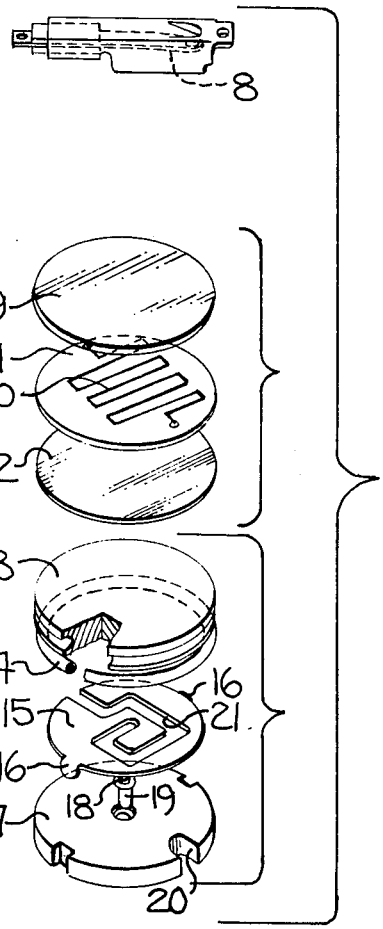
FIG. 3 is an exploded view of one heat exchange embodiment.

FIGS. 1 and 2 show the exterior housing details of one embodiment of the portable, compact heating device of the present invention. The housing 1 is designed to bring the center of gravity of the device, when plugged into a wall receptacle, as close to the wall as possible to minimize torque exerted on the prongs 5 and 6. A nozzle 2 having a lather exit channel 3 is provided, the channel 3 leading back to a cavity 7A in which a heat sink means similar to that shown in FIG. 3 is located. An adapter 7 for an aerosol can valve also leads to the cavity 7A as discussed later herein.

Preferably, the prongs 5 and 6 are located proximate the aerosol can adapter 7 to prevent simultaneous use of an electrical wall outlet or extension with an aerosol can, thereby forcing the user to remove the prongs 5 and 6 from the electrical outlet before attaching the housing 1 to the aerosol can.

Additionally, a signaling means 4 such as an electrical lamp is positioned in housing 1 for ease of viewing and is energized upon attachment of a desired temperature.

Figure 4:
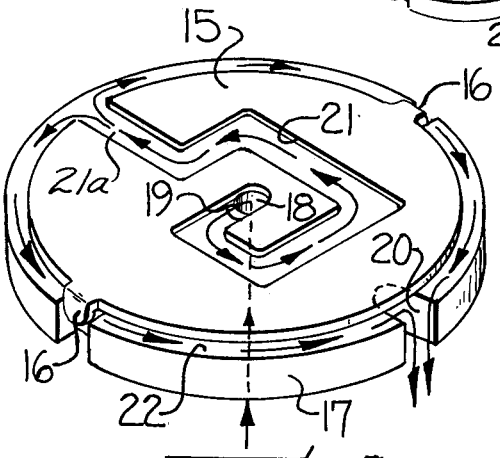
FIGS. 4 and 5 are alternative embodiments of the heat sink utilized in the present invention.

The composite structure shown in FIG. 3 is located in the cavity 7A directly over aerosol can adapter orifice and comprises two discs 13 and 17 of aluminum or other high heat conductive material between which is sandwiched a third disc 15 of slightly smaller diameter having positioning tabs 16 more clearly shown in FIG. 4. Disc 13 is shown with appropriate sealing means 14, such as an "*o*" ring, to prevent escape of lather between the cavity 7A and disc 13 into the electrical section of the housing 1.

Figure 6:
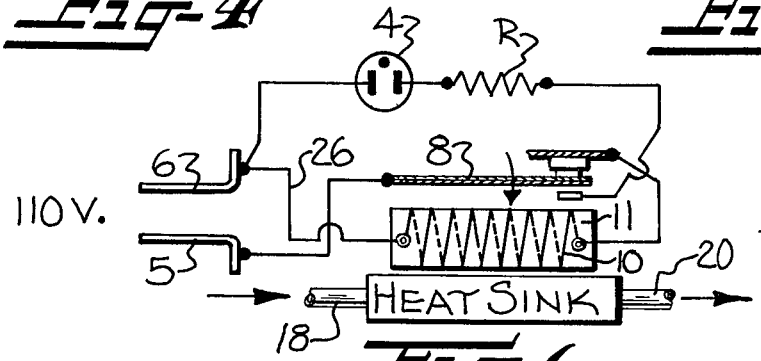
FIG. 6 is a schematic electrical diagram of the circuitry utilized in the embodiment of FIG. 3.

In the embodiment of FIGS. 3 and 4, a wafer heating coil 10 is formed with a support 11 of appropriate insulation means. Electrical wiring is as shown in FIG. 6. Support 11 is positioned between spacers 9 and 12 of high electrical resistance high thermal conductance material, such as mica. The thicknesses of spacers 9 and 12 are proportioned to transmit sufficient thermal energy to energize thermostatic switch 8 adjacent one spacer 9 simultaneously as heat sink discs 13, 15 and 17 have reached their desired temperature.

As indicated, discs 13, 15 and 17 act in conjunction as a heat sink in which thermal energy transmitted thereto by heating coil 10 is stored for later transfer to foam shaving lather passing through channels in the heat sink. FIG. 4 is illustrative of one embodiment and shows only discs 15 and 17; since, in this embodiment, disc 13 has simply a flat, smooth mating surface.

Disc 15 is smaller in diameter than disc 17 and therefore forms a channel 22 around disc 15 the depth of the disc 15 (shown in FIG. 2). Tabs 16 position the disc 15 so that the channel dimensions are substantially uniform. The tabs 16 are designed to permit lather flow around them, here simply being "pinched" to a height dimension smaller than the disc 15.

A channel 21*a* formed by the surface 21 and the mating surfaces of discs 13 and 17 directs lather coming into the channel an orifice 18 formed in this embodiment by a brad 19 extending through the aerosol can adapter 7 (FIG. 2) and disc 17. The brad 19 serves to prevent lather from getting underneath disc 17 during operation. The lather flows from the channel 21*a* around through channels 22 to notch 20 in disc 17 which directs the lather to the exit orifice 3 as shown in FIG. 2. The channels are designed (*a*) to provide sufficient contact of the lather to the heat sink to heat the lather to 120°–140° F, and (*b*) to restrict flow of the lather through the heat sink on a momentary impulse of an aerosol can valve to 3–5 grams of lather at the desired temperature.

Figure 5:
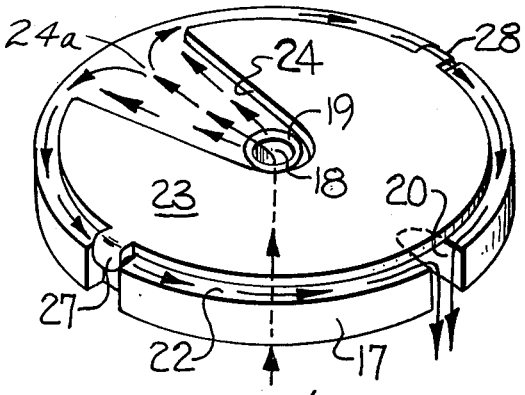

In FIG. 5, an alternative embodiment of the heat sink of the present invention is shown sans disc 13 for the same reason above stated. Disc 23 has an opening around inlet 18 and brad 19. A channel 21*a* defined by surfaces leads out to channel 22 as in FIG. 4. Tabs 27 and 28 on disc 23 are bent into notches 28 and to locate disc 23 on disc 17 and to not impede flow of lather through channel 22 to notch 20 in disc 17, as described earlier.

In FIG. 6, prong 5 is connected through appropriate wiring to a two-position thermostatically controlled electrical switch 8. Male prong 6 is connected through electrical wiring 26 to one terminal of the heating coil 10, while the other terminal of coil 10 is connected to the normally closed contact terminal of switch 8. Electrical lamp 4 and appropriate protective resistance means R are connected in parallel with coil 10 through the normally open contact terminal of switch 8 to prong 6.

In operation, male prongs 5 and 6 are plugged into an appropriate electrical receptical, supplying electrical energy compatible with the components of the system and sufficient to excite the heating coin- here shown as conventional 110 volt alternating current (50–60 Hz).

An electrical circuit is completed through the normally closed contact of switch 8 and heating coil 10 until sufficient heat has been transmitted through disc 9 (FIG. 3) to heat the thermostat to an activating temperature, whereupon the heating coil circuit is broken and a circuit is completed through the normally open (now closed) contact of switch 8 and lamp 4 to indicate the desired temperature of the heat sink has been attained. The device may then be unplugged and attached to a nozzle valve of an aerosol can for actuation. Should the heat sink cool below a desired temperature range, the thermostatic switch will close and reenergize the heating coil if plugged into a receptacle until the desired temperature range is regained.

Adapter 7 is designed to fit over the nozzle valve of an aerosol can and support the housing 1 thereon. Sufficient clearance only is provided around adapter 7 to permit a simple push downward or sideways to actuate the aerosol can valve and release foam shaving lather.

EXAMPLE I

A lather heating embodying the arrangement of FIGS. 1, 2 and 5 is constructed, whereupon it is inserted into a 110 volt 60 Hz alternating current electrical outlet for 55 seconds until the temperature to the thermostat reaches 200±5° F., whereupon the thermostatic switch is activated closing the lamp circuit causing the lamp to glow. The temperature of the heat sink is measured to be 250° F.

The device is removed from the electrical outlet and affixed atop an aerosol shaving lather container. The housing 1 is pressed momentarily downward, releasing approximately 4 grams of lather into and through the heating device. The temperature of the lather at the exit orifice 3 is measured as 120° F.

EXAMPLE II

A device similar in all respects to Example I is constructed except the heat sink of FIG. 5 is substituted therein. Heating as in Example I is followed with a resultant approximate 5 grams of lather heated to 140° F. being produced.

While particular embodiments have been set forth herein, the present invention is not intended to be limited by the description, but is to be as set forth in the attached claims.

What is claimed is:

1. Apparatus for heating fluid dispensed from a container and comprising:

housing means for passing fluid being dispensed and having an entrance orifice adapted to receive an outlet nozzle of a container, an exit orifice for delivering heated fluid and conduit means establishing operative fluid heating means in said housing means for heating fluid passing therethrough and having heat sink means for storing heat and disposed in heat transfer relation to said conduit means for heating lather therein and electrical heating means for heating said heat sink means, and electrical connector means on said housing and electrically connected to said electrical heating means for conducting electrical current thereto, said connector means and said entrance orifice being so disposed one relative to the other that connection of said connector means with a source of electrical current prevents said entrance orifice from receiving an outlet nozzle of a container and receipt of an outlet nozzle of a container by said entrance orifice prevents said connector means from connecting with a source of electrical current, said heat sink means having a thermal capacity capable of storing during conductance of electrical current through said electrical heating means thermal energy sufficient to heat a charge of fluid to a desired temperature after conductance of electrical current has been interrupted by disconnecting of said connector means.

2. Apparatus according to claim 1 wherein said electrical heating means comprises an electrical resistance coil and thermostatic switch means electrically connected in series with said coil for controlling flow of electrical current therethrough, said switch means being mounted in heat transfer relation to said coil and opening on rising temperatures.

3. Apparatus according to claim 2 wherein said heat sink means, said coil and said switch means superposed in stacked array and further comprising first and second thermally conductive, electrically insulating spacer means respectively interposed between said heat sink means and said coil and between said coil and said switch means, said first and second spacer means having a ratio of thermal conductivity correlated to the opening temperature of said switch means and a desired temperature for said sink means such that said switch means de-energizes said coil upon said heat sink means reaching the desired temperature.

4. Apparatus for heating lather dispensed from a pressurized container and comprising:

housing means for passing lather being dispensed and having an entrance orifice adapted to receive an outlet nozzle of a pressurized shaving lather container and an exit orifice for delivering heated lather, lather heating means said housing means for heating lather passing therethrough and having heat sink means for storing heat and for defining at least a portion of a conduit establishing operative communication between said entrance orifice and said exit orifice and electrical heating means for heating said heat sink means, and electrical connector means on said housing and electrically connected to said electrical heating means for conducting electrical current thereto, said connector means and said entrance orifice being so disposed one relative to the other that connection of said connector means with a source of electrical current prevents said entrance orifice from receiving an outlet nozzle of a lather container and receipt of outlet nozzle of a lather container by said entrance orifice prevents said connector means from connecting with a source of electrical current, said heat sink means having a thermal capacity capable of storing during conductance of electrical current through said electrical heating means thermal energy sufficient to heat a charge of lather to a desired temperature after conductance of electrical current has been interrupted by disconnecting of said connector means.

5. Apparatus according to claim 4 wherein said heat sink means comprises first, second and third members superposed in stacked array, said first member having a lather entrance opening for operative communication with said entrance orifice of said housing means, said second member having an inner channel for operative communication with said lather entrance, and said third member cooperating with said first and second members for confining lather to said channel.

6. A method of heating fluid dispensed from a container and comprising the steps of providing a housing having an entrance orifice adapted to receive and communicate with the outlet of a container, an outlet orifice and a heat sink in heat exchange relationship with a fluid flow passage connecting the entrance orifice with the outlet orifice, said housing further having an electrical heating element for heating the heat sink to a predetermined temperature and electrical connector means on said housing for connecting the heating element to a source of electrical current, said connector and said entrance orifice arranged in such predetermined spaced relationship with each other on said housing that the connector and entrance orifice cannot be simutaneously connected, respectively, with a source of electrical power and the outlet of a container, said heat sink being capable, after having been heated to a predetermined temperature, of storing thermal energy sufficient to heat a charge of fluid flowing through said flow passage to a desired temperature, connecting the electrical connector with a source of electrical current while thereby preventing connection of the entrance orifice with a container outlet and while conducting electrical current through said electrical heating element housed in heat transfer relation with said heat sink and heating said heat sink to said predetermined elevated temperature, then disconnecting the electrical connector from the source of electrical current, then connecting the entrance orifice with the outlet of a container while thereby preventing connection of the electrical connector with a source of electrical current, and then dispensing fluid from the container while passing dispensed fluid through said flow passage in heat transfer relation with the heat sink and heating the dispensed fluid.

* * * * *

UNITED STATES PATENT AND TRADEMARK OFFICE

CERTIFICATE OF CORRECTION

PATENT NO. : 4,056,707

DATED : November 1, 1977

INVENTOR(S) : Franklin C. Farnam

It is certified that error appears in the above-identified patent and that said Letters Patent are hereby corrected as shown below:

Column 2, Line 24 delete "attachment" and insert therefor - attainment - ;
Column 3, Line 10 following "surfaces" insert - 24 -;
Column 3, Line 28 delete "coin" and insert therefor - coil -;
Column 3, Line 51 following "heating" insert - device -;
Column 3, Line 68 delete "5" and insert therefor - 4 -;
Column 4, Line 15 following "operative" insert - communication between said entrance orifice and said exit orifice, -;
Column 4, Line 56 following "for said" insert - heat -.

Signed and Sealed this

Fourth Day of April 1978

[SEAL]

Attest:

RUTH C. MASON
Attesting Officer

LUTRELLE F. PARKER
Acting Commissioner of Patents and Trademarks